United States Patent [19]

Dallen

[11] 3,958,383

[45] May 25, 1976

[54] GLAZING SYSTEM

[75] Inventor: John A. Dallen, Port Clinton, Ohio

[73] Assignee: The Standard Products Company, Cleveland, Ohio

[22] Filed: Mar. 19, 1975

[21] Appl. No.: 559,801

[52] U.S. Cl. ..... 52/400; 52/208; 52/396

[51] Int. Cl.[2] ..... E04B 1/62; E04F 15/14

[58] Field of Search ..... 52/204, 396, 397, 400, 52/402, 403, 62, 208

[56] References Cited

UNITED STATES PATENTS

| | | | |
|---|---|---|---|
| 2,056,024 | 9/1936 | Stuart | 52/400 |
| 2,877,515 | 3/1959 | Haas | 52/402 |
| 2,979,788 | 4/1961 | Richardson | 52/400 |
| 3,254,461 | 6/1966 | White et al. | 52/397 |
| 3,344,573 | 10/1967 | Martin | 52/400 |
| 3,381,434 | 5/1968 | Carson | 52/397 |
| 3,500,603 | 3/1970 | Strack | 52/403 |
| 3,837,130 | 9/1974 | Hildenbrandt | 52/208 |
| 3,846,948 | 11/1974 | Dallen | 52/396 |
| 3,866,374 | 2/1975 | Dallen | 52/208 |

*Primary Examiner*—Ernest R. Purser
*Assistant Examiner*—Robert Farber
*Attorney, Agent, or Firm*—Harness, Dickey & Pierce

[57] ABSTRACT

A glazing system for window panes and other panels utilizes separate but generally similar L-sectioned elastomeric stops on each side of the pane. The stops are fitted into a double-grooved supporting frame or reglet structure having an outer groove surrounding the pane and which opens outwardly in a direction perpendicular to the pane, and having an inner groove opening in a direction inwardly of but parallel to the pane and spaced rearwardly from the plane of the pane. The outer stop has one leg retained in the outer groove and its other leg projecting parallel to and overlying and bearing inwardly against the pane. The inner stop has one leg retained in the inner groove and its other leg projecting perpendicular to the pane, with the end of such last-mentioned leg butting against the pane. In another embodiment of the invention the inner stop is of a modified U-section, having a glass holding leg and a retaining leg, said legs being parallel to each other.

26 Claims, 6 Drawing Figures

GLAZING SYSTEM

BACKGROUND OF THE INVENTION

The object of the present invention is to provide an improved, simplified and relatively inexpensive means for supporting and effectively sealing window panes and other panels which may be exposed on one side to the weather.

Elastomeric strips of various cross-sectional configurations have been employed in the past to retain and seal window panes, fill-in panels and the like in the window openings and equivalent retaining frames of buildings. In modern building construction wherein the openings are employed with fixed sash and infill panels which normally remain permanently in place unless replacement becomes necessary due to breakage, it has become important, particularly in view of the extensive use of glass, to provide glazing means which is relatively low in cost, but which is neat in appearance, compact, so that interruption of the glass surface of multipaned installations is minimized, and which is effective in its sealing function but which nevertheless permits ready removal and replacement of broken panes.

Typical prior art solutions to problems of the indicated nature have involved either the use of a sealant on one side of the window pane and an elastomeric retainer on the other side, or a single elastomeric retainer which embraces the edge and extends over both sides of the panel. The former class of glazing system depends for its effectiveness to a very substantial degree upon the effectiveness and long-term stability of the sealant. The other type, using a single elastomeric retainer embracing both sides of the light normally requires separate clamping means for effective sealing, and removal and replacement of a broken pane is frequently difficult or infeasible when necessary to work from the side opposite that from which the unit was installed. The present invention aims to provide an improved system overcoming the indicated and other problems, wherein separate but similar elastomeric stops are employed both exteriorly and interiorly of the pane, no sealant being required, and the arrangement being such that the pane, although effectively held, is readily removable and replaceable either from inside or outside the building.

Another object is to provide such a system which is relatively low in cost and quick and easy to install.

Another object is to provide such a system which constitutes an improvement upon the system disclosed in my U.S. Pat. No. 3,846,948, entitled "Glazing System", and issued Nov. 12, 1974.

Other objects and advantages will become apparent upon consideration of the present disclosure in its entirety.

BRIEF DESCRIPTION OF THE FIGURES OF DRAWING

DETAILED DESCRIPTION OF PREFERRED FORMS OF THE INVENTION

Figure 1:
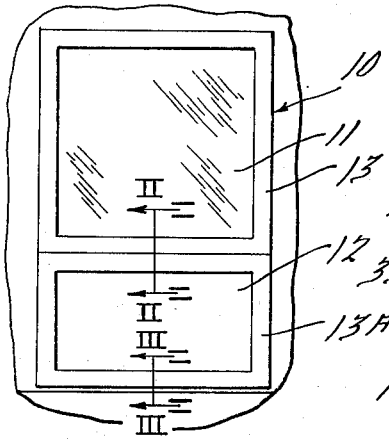
FIG. 1 is an elevational view of a multi-panel glazing installation constructed in accordance with the present invention.
Figure 2:
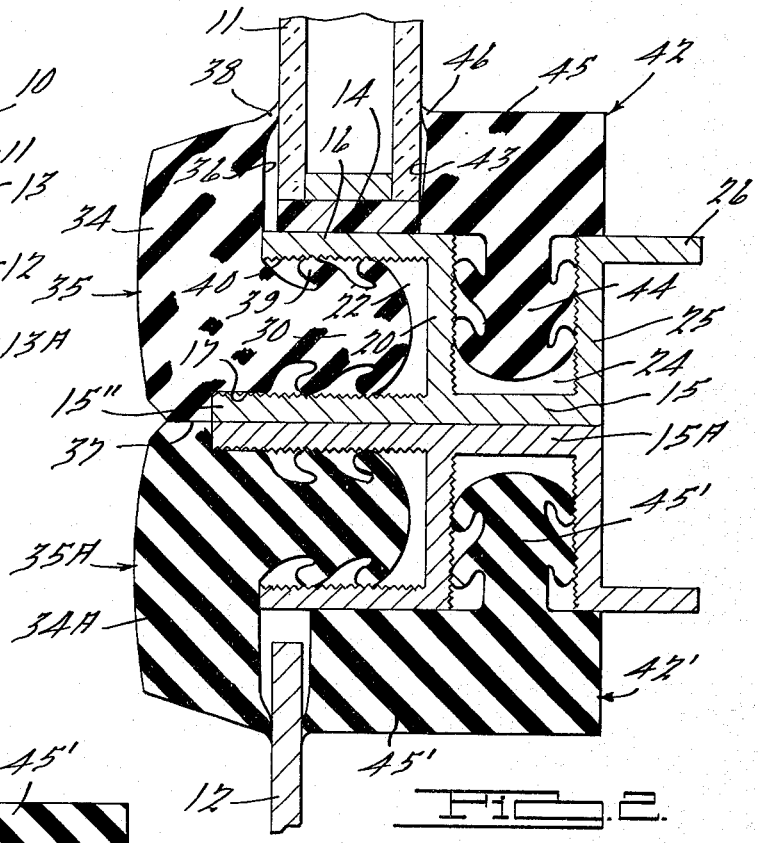
FIG. 2 is a vertical cross-sectional view taken substantially on the line II—II of FIG. 1 and looking in the direction of the arrows.
Figure 3:
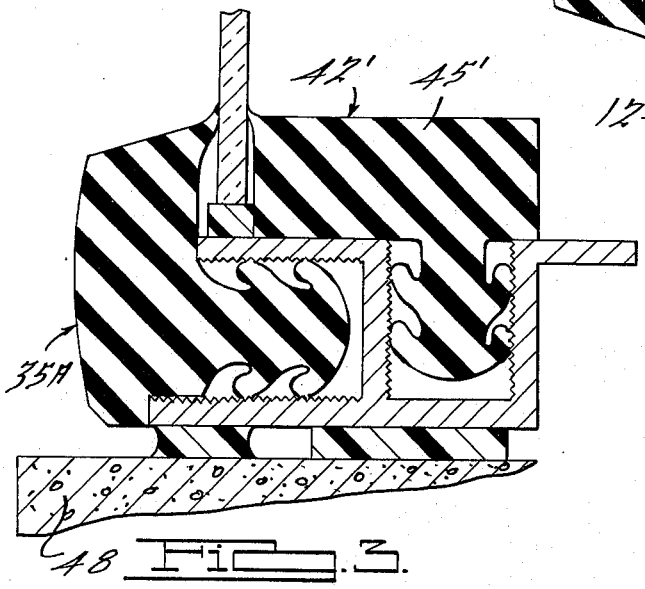
FIG. 3 is a vertical cross-sectional view taken substantially on the line III—III of FIG. 1 and looking in the direction of the arrows.
Figure 4:
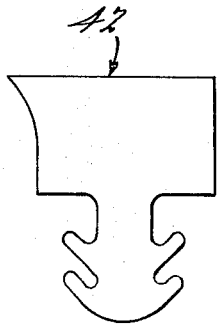
FIG. 4 is a cross sectional view of the inner stop in its relaxed shape.
Figure 5:
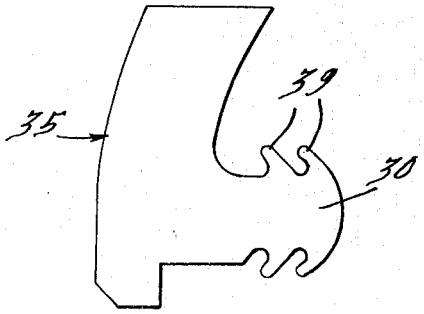
FIG. 5 is a cross-sectional view of the outer stop in its relaxed shape.

Reference character 10 designates generally a frame structure for the retention of two adjacent panels, comprising a double-pane insulating window light 11 and a fill-in panel or spandrel 12 arranged below the window light. Both panels are shown as of rectangular form. Each panel is retained in a rectangular frame assembly formed of straight sections of a rigid material such as an extruded aluminum alloy, all of the extruded sections being uniform in cross section. The cross section of the extrusion is shown in FIG. 3, which illustrates the lower supporting sill area for the fill-in panel. The frame for the panel 11 is generally designated 13, and the frame for the panel 12 is generally designated 13A. The frame portions and other parts which support panel 12 are designated by the same reference numerals as are used in connection with those for the panel 11, but distinguished by the addition of the letter A, and are of the same construction except where otherwise indicated, so that specific referral to and description of identical parts will not be required. The perimetrically outer wall portion 15 of each extrusion is flat and in the horizontal muntin area between the superposed panels the extrusions are back-to-back and the abutting flat wall portions 15, 15A are preferably rigidly secured together in sealed relation by welding or other conventional fastening means. In the construction illustrated, the outside of the building is shown at the left in FIGS. 2 and 3. Each extruded metal section includes a flat planar inner perimetric wall portion 16 constituting a panel locating and supporting flange which is spaced from its outer wall 15. The wall portion 15 extends rearwardly, perpendicular to the building wall, farther than the flange 16. Such wall and flange portions are connected by an intermediate web 20 which, with the wall 15 and flange 16, defines a continuous outwardly-facing channel 22.

Another channel 24 is defined by the rearwardly-extending portion of wall 15 and a perpendicular flange 25 projecting therefrom in the same direction as the flange 20, the spacing of flanges 20, 25 corresponding to the spacing between wall 15 and flange 16. The channel 24 faces toward but is parallel to the inside surface of the supported panel. A continuation flange 26 at right angles to the flange 25 and coplanar with the flange 16 is adapted to be supported by suitable structural means (not shown) incorporated in the building, or in center mullion and muntin areas, to a support a suitable fill strip (not shown).

Cushioning or setting blocks 14 may be arranged between the panel and flange 16 in the usual way.

Resilient elastomeric stop means adapted to sealingly engage and retain the panels are provided exteriorly and interiorly and may be of generally similar construction, each stop extending continuously around its panel. Each outer stop member consists of a stop-retaining leg flange 30, which extends continuously along and within the channel 24, and a panel holding leg flange 34, perpendicular to the leg 30, and extending lengthwise continuously in overlapping relation to the surface of the panel. The outer stop, which is generally designated 35, has its flange 34 extending parallel to and overlapping the outer surface of the light, the under surface of flange 34 being relieved as indicated at 36 to clear the flange 16 and to provide a lip 38 at its outer corner which projects against and is deformed by its engagement with the surface of the panel, in order to yieldably press against and retain the same and to maintain itself in sealing engagement with the panel. The leg 30 has a plurality of longitudinal laterally projecting ribs 39 which are deformed by the insertion of the leg 30 in the channel 22 and which are shaped to oppose movement of leg 30 out of the channel. The inner walls of the channel are preferably provided with irregularities 40 which coact with ribs 39 to increase the resistance of the stop to escape.

The inner stop, which is generally designated 42, has a continuous stop-retaining leg flange 44 which is similar to leg 30 of the outer stop 35. Leg 44 is inserted in the channel 24 in similar fashion to the installation of the outer stop in channel 22. The holding leg flange 44 of the inner stop 42 extends perpendicularly to the panel 11, so that the end wall of its leg 45 butts against the inner surface of the panel. The end wall of the leg 45 has a shallow round-bottomed relief channel 43 and its outer corner 46 bears against the inner surface of the panel, as shown. The length of the leg 45 is related to the thickness of the panel so that sufficient compressive force for effective retention and sealing of the panel by and between the lips 38, 46 is achieved, the dimensioning of the stops being such that the lips 38 and 46 are substantially aligned on opposite sides of the panel.

It will be recognized that in constructions, or portions of a construction, where no other panel lies closely beside a retained panel, the wall 15 may be seated against the structural part of the building which defines the opening, as in the case of the sill 48 shown in FIG. 3. Where two panels are close together, however, as in the case of the light 11 and panel 12 in the area of the section II—II, the adjacent extrusions form in effect a single muntin (or mullion) for the adjacent panels. Such an arrangement is shown in FIG. 2, wherein, as indicated above, the upper panel 11 is a double-paned thermal glass light, while the lower panel 12 is a spandrel or fill-in panel. The thermal glass light panel 11 is of course substantially thicker than a normal light or panel of single thickness such as the panel 12. The difference in thickness may be accommodated by shortening the holding leg of the inner stop. Thus in an arrangement such as that shown it is possible for the architect to spacify glazing components all of which are alike, except for the inner stop. Portions of the inner stop 42′ for panel 12 corresponding to those of the inner stop 42 for light 11 are designated by like reference numerals primed, and no detailed redescription thereof will be required.

It will be observed that the wall portions 15 extend outwardly, as indicated at 15″, farther than the flange 16, and that the rear face of leg portion 34 is rabbeted to define a surface 17 which bears against such extension portions 15′. Any outward force on the retained panel tends not only to flex the outer leg 34 but also to rock it bodily around the neck area formed by its juncture with the retaining leg 30. Such rocking is opposed by the backup effect of the extension 15″. The rear or outer ends of head portions 34, 34A extend over the outer ends of walls portions 15, thereby concealing the ends of wall portions 15 and further strengthening the resistance of the holding legs to unwanted deformation, and where adjacent panels are supported by back-to-back frame elements as in FIG. 2, the rear edges of holding legs 34, 34A abut one another as indicated at 37.

The outer stop for each panel may be molded in one piece to uninterruptedly encircle the panel, or individual sections for each edge may be provided, cemented or otherwise sealed together at the corners. The stops are sufficiently resilient so they can be pried from and pulled out of the channels 22, 24, etc., but are stiff enough to firmly retain themselves and the panels in position. No portion of the rigid frame structure obstructs removal of the panel from either side. Thus the held panel can conveniently be rplaced either from the interior or the exterior of the building. This is highly advantageous in view of the fact that quite frequently one side becomes obstructed by necessary apparatus after the initial glazing, as for example, by machinery or equipment installed in a building, or by a permanent protective parred window grille or the like.

Figure 6:
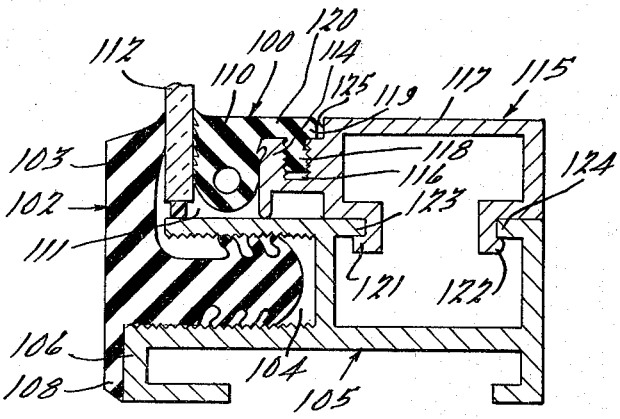
FIG. 6 is a cross-sectional view corresponding to FIG. 3 showing a modified construction utilizing an inner stop of a different cross-sectional contour.

It will be recognized that the framing structure, except for the channels and parts which cooperate with the stops and with the retained panels, will vary in accordance with the structural and aesthetic requirements of the building, and that such framing details which are not directly involved with the glazing do not form a part of the present invention. In the modified construction shown in FIG. 6, the glazing system is adapted to cooperate with interior framing and sill members which conceal the inner stop more effectively from the view of persons within the building. Since the stops are normally formed of a black elastomer, such as neoprene, because of its greater resistance to actinic light than materials of lighter color, it is sometimes considered desirable for aesthetic reasons to limit the extent to which the inner stop overlaps the unframed portion of a window light. The outer stop 102, in this modified construction, is similar to the outer stop 34, except that the portion 106 of the frame member 105 which would be exposed outside the building but for the overlying portion of the outer stop is covered by a relatively longer rearwardly overlapping flange portion 108 of the head of the outer stop. Stop 102 is similarly retained in a channel 104 in an extruded frame member 105.

The inner stop 100 is of modified U-section, having one leg flange 110 constituting the panel holding leg, which backs up the supported window light 112, opposite the overlying head portion 103 of stop 102. The channel 111 for panel holding leg flange 110 is formed on the outer side by the panel 112, and on the inner side by a vertical wall 114 of a frame member 115. The frame member 115 has a channel 116 parallel to but spaced inwardly from the channel 111 and opening toward but parallel to the plane of the panel to receive the retaining leg 118 of the stop 100. The retaining leg 118 may, as shown, be of smaller cross section than the leg flange 110. The bight portion 120 of the stop 100 overlies the edge of the wall 114. Both of the leg flanges 110 and 118 may be provided with longitudinal ribs adapted to coact with serrations on the outer face of wall 114 and on both inner faces of the channel 116.

By virtue of this arrangement, the retaining leg 118 is effective to hold the stop 100 in position under adverse conditions despite the fact that it is parallel to the main sealing leg 110. It will be appreciated that when installed in a position inverted from that shown in FIG. 6; that is, over the top of the pane, in a header or horizontal muntin, gravity tends to dislodge the stop 100. Even if a strong outward force on the glass should loosen the glass-engaging leg 110, however, the inverted stop portion cannot drop from channel 111, since it is retained by leg flange 118, which is snugly fitted in channel 116. A shoulder 119, forming a rearward extension of the top portion of stop 100, overlies a shoulder-defining rabbet 125 at the juncture of channel 116 and wall 117, thereby opposing unwanted bending in the bight area which might allow the leg 110 to swing outwardly with respect to its channel independently of leg 118.

As indicated above, the detailed form and structure of the portions of the framing members which extend away from the glazing supporting parts may vary, but it should be noted that by virtue of the rabbet 125 the outer surface of the stop 100 is substantially flush with the surface of the wall portion 117 of the framing member 115 which extends inwardly of the building. Although part 115 is shown as a sill, the side jamb and header portions may be constructed similarly to sill framing member 115, and these parts may be finished smoothly and/or in any desired ornamental manner, such as by means of an anodized coating. In the construction shown, the framing member 115 is frictionally attached to the framing member 105 by means of interfitted lip-like flanges 121, 122, 123, 124 which permit the sill frame member 115 to be detached from the frame member 105 by pressing its sides together. Other securing means may of course be employed for the framing portion 115, however.

It will be recognized that the fact that both stops can be inserted and removed by forcing them into or pulling them out of their respective channels 111, 116, and that the sill framing member 115 and corresponding side and header members are removable, makes it possible to glaze or reglaze the opening either from inside or outside the building in essentially the same manner as in the first embodiment.

This Detailed Description of Preferred Forms of the Invention, and the accompanying drawings, have been furnished in compliance with the statutory requirement to set forth the best mode contemplated by the inverter of carrying out the invention. The prior portions consisting of "Abstract of the Disclosure" and the "Background of the Invention" are furnished without prejudice to comply with administrative requirements of the Patent Office.

What is claimed is:

1. Means for positioning a windowpane panel or the like in a building structure comprising in combination with a rigid frame structure for receiving and positioning the panel, said frame structure including a pair of channels bordering the panel and one of which opens on one side of the panel and the other of which opens on the other side of the panel, but neither of which channels opens toward the panel, a pair of elastomeric stop members, each of which includes a stop retaining leg flange fitted in one of said channels and a panel holding leg flange integral with and spaced from the stop retaining leg flange and overlying and bearing against a face of the panel.

2. Means as defined in claim 1 wherein said stops are of substantially right angular cross section and frictionally retained in said channels, whereby said stops are individually insertable into holding position in their respective channels and individually removable therefrom.

3. Means as defined in claim 1 wherein the panel holding leg flange of the stop which is located in the first-mentioned channel lies at a substantial angle to the retaining leg flange thereof and bears laterally against the panel, whereby said last-mentioned stop is subjected to bending stress by displacement of the panel toward the panel holding flange.

4. Means as defined in claim 3 wherein the panel holding leg flange of the other stop bears longitudinally against the panel whereby said last-mentioned flange is subjected to compressive stress by displacement of the panel toward said last-mentioned flange.

5. Means as defined in claim 4 wherein each of said stops has its panel holding leg flange lying at a substantial angle to the stop retaining leg flange.

6. Means as defined in claim 4 wherein said panel leg flange of said other stop is confined between the panel and a portion of the frame structure.

7. Means as defined in claim 6 wherein the stop retaining leg flange of said other stop is parallel to the panel holding leg flange thereof.

8. Means for positioning in a building structure a windowpane panel or the like having substantially parallel inner and outer surfaces, comprising in combination a pair of elastomeric stop members each of which includes a retaining leg and a panel holding leg, said legs being at a substantial angle to each other, means for supporting one of said stop members with its panel holding leg parallel to and overlying one surface of the panel, and means for supporting the other stop member with its panel holding leg perpendiculalr to the other surface of the panel and its end bearing against the panel.

9. Means as defined in claim 8 wherein the means for supporting said stops comprises a frame element having an outer channel for the outer stop bounding and close to the edge of the panel and opening outwardly in a direction perpendicular to the plane of the panel, said frame element also having an inner channel for the inner stop farther from the panel and opening inwardly in a direction parallel to the plane of the panel.

10. Means as defined in claim 9 wherein the channels in the frame element are arranged perpendicularly to each other with a common web wall forming the bottom of one channel and the side of the other.

11. Means as defined in claim 9 wherein the channels in the frame element are of like size and arranged perpendicularly to each other with a common web wall forming the bottom of one channel and the side of the other.

12. Means as defined in claim 9 wherein the channels in the frame element are arranged perpendicularly to each other with a comon web wall forming the bottom of the outer channel and the side of the inner channel.

13. Means as defined in claim 9 wherein the channels in the frame element are of like size and arranged perpendicularly to each other with a common web wall forming the bottom of the outer channel and the side of the inner channel.

14. Means as defined in claim 9 wherein the inner wall of the outer channel is defined by an inwardly spaced flange forming a positioning wall for the panel.

15. Means as defined in claim 12 wherein the outer channel has a side wall extending perpendicularly from the free end of the inner channel and forming a positioning wall for the panel.

16. A combination as defined in claim 8 wherein both stop members are generally L-shaped in cross section.

17. A combination as defined in claim 10 wherein both stop members are generally L-shaped in cross section.

18. A combination as defined in claim 8 wherein the panel holding leg of one stop extends parallel to the panel and the panel holding leg of the other stop extends perpendicular to the panel.

19. A combination as defined in claim 9 wherein the panel holding leg of the outer stop extends parallel to the panel and the panel holding leg of the inner stop extends perpendicular to the panel.

20. A combination as defined in claim 10 wherein the panel holding leg of the outer stop is longer than the panel holding leg of the inner stop.

21. A combination as defined in claim 15 wherein the panel holding leg of the outer stop is longer than the panel holding leg of the inner stop.

22. A combination as defined in claim 10 wherein the outer stop member is generally L-shaped in cross section and has its holding leg projecting out of the outer channel in overlying relation to the panel, the frame element having an extension portion on one side of the outer channel and overlying at least a part of the end of the holding leg of the stop farthest from the panel.

23. A combination as defined in claim 12 wherein the frame element has a substantially flat perimetral wall portion forming one side of the outer channel and a flange inwardly spaced from said outer wall portion forming the inner side of the outer channel and projecting outwardly from said common web wall and forming a positioning wall for the panel.

24. A combination as defined in claim 12 wherein the frame element has a substantially flat perimetral wall portion forming one side of the outer channel and a flange inwardly spaced from said outer wall portion forming the inner side of the outer channel and projecting outwardly from said common web wall and forming a positioning wall for the panel, the perimetral wall extending outwardly, in a direction perpendicular to the panel, farther than the inwardly spaced flange.

25. A combination as defined in claim 12 wherein the frame element has a substantially flat perimetral wall portion forming one side of the outer channel and a flange inwardly spaced from said outer wall portion forming the inner side of the outer channel and projecting outwardly from said common web wall and forming a positioning wall for the panel, the perimetral wall extending outwardly, in a direction perpendicular to the panel, farther than the inwardly spaced flange, and overlying a perimetral surface of the outer stop.

26. A combination as defined in claim 12 wherein the frame element has a substantially flat perimetral wall portion forming one side of the outer channel and a flange inwardly spaced from said outer wall portion forming the inner side of the outer channel and projecting outwardly from said common web wall and forming a positioning wall for the panel, the perimetral wall extending outwardly, in a direction perpendicular to the panel, farther than the inwardly spaced flange and projecting into a relieved area of the outer stop.

* * * * *

UNITED STATES PATENT AND TRADEMARK OFFICE

CERTIFICATE OF CORRECTION

PATENT NO. : 3,958,383

DATED : May 25, 1976

INVENTOR(S) : John A. Dallen

It is certified that error appears in the above-identified patent and that said Letters Patent are hereby corrected as shown below:

Column 1, line 60, "multi-panel" should be --multi-paned--.
Column 2, line 62, "panels" should be --panel--.
Column 3, line 22, "44" should be --45--.
Column 3, line 60, "flange" should be --flanges--.
Column 4, line 1, "walls" should be --wall--.
Column 4, line 17, "rplaced" should be --replaced--.
Column 4, line 23, "parred" should be --barred--.
Column 5, line 45, "inverter" should be --inventor--.
Column 5, line 47, after "of" insert --the--.
Column 6, line 55 (Claim 12, line 3), "comon" should be --common--.

Signed and Sealed this

Tenth Day of August 1976

[SEAL]

*Attest:*

RUTH C. MASON
*Attesting Officer*

C. MARSHALL DANN
*Commissioner of Patents and Trademarks*